United States Patent [19]
Tulis et al.
[11] 4,230,509
[45] Oct. 28, 1980

[54] PYROPHORIC FLAME COMPOSITION

[75] Inventors: Milton A. Tulis; Charles M. Lawson, both of Joppa; Lawrence D. Whiting, III, Bel Air, all of Md.

[73] Assignee: The United States of America as represented by the Secretary of the Army, Washington, D.C.

[21] Appl. No.: 29,809

[22] Filed: Apr. 13, 1979

[51] Int. Cl.[3] ..... C06B 43/00
[52] U.S. Cl. ..... 149/109.4; 149/87
[58] Field of Search ..... 149/87, 109.4

[56] References Cited

U.S. PATENT DOCUMENTS

| | | | |
|---|---|---|---|
| 3,242,667 | 3/1966 | Kidwell | 149/87 |
| 3,634,156 | 1/1972 | Batson | 149/87 |
| 3,634,157 | 1/1972 | Batson | 149/87 |
| 3,795,556 | 3/1974 | Sippel et al. | 44/7 E |
| 3,883,376 | 5/1975 | Billig et al. | 149/109.4 |

*Primary Examiner*—Edward A. Miller
*Attorney, Agent, or Firm*—Nathan Edelberg; Robert P. Gibson; A. Victor Erkkila

[57] ABSTRACT

A low viscosity liquid pyrophoric composition, which provides good safety under ordinary handling conditions but ignites rapidly when disseminated into the atmosphere, consists essentially of about from 50% to 85% by weight of a homogeneous solution of polyisobutylene in triethylaluminum and about from 15 to 50% of a saturated aliphatic hydrocarbon of 5 to 12 carbon atoms, said composition having a viscosity ranging about from 30 to 150 centistokes at 40° C. When explosively disseminated into the atmosphere, the composition generates a fireball having a controlled ignition delay, which permits essentially complete vaporization of the hydrocarbon prior to ignition of the TEA, thereby producing rapid pulses of intense thermal radiation having a temperature as high as 1200° C. (2192° F.) and higher.

6 Claims, No Drawings

PYROPHORIC FLAME COMPOSITION

GOVERNMENTAL INTEREST

The invention described herein may be manufactured, used and licensed by or for the Government for governmental purposes without the payment to us of any royalties thereon.

BACKGROUND OF THE INVENTION

In recent years, the U.S. Army has developed a pyrophoric flame composition composed of triethylaluminum (TEA) thickened with polyisobutylene (PIB) to a viscosity of 200,000±50,000 centistokes (cs) at 40° C. When this flame agent is delivered and explosively disseminated on targets as in a U.S. Army M74 Flame round the composition is disseminated as relatively large particles (globs and ligaments) resulting in heat fluxes of 1 to 2 cal/cm$^2$-sec at temperatures ranging from 800° to 1500° F.

We have recently discovered that greater heat fluxes can be produced by merely lowering the viscosity of the PIB-TEA-solution. Thus, PIB-TEA solutions having a viscosity within the range of from 50 to 100 cs at 40° C. produce heat fluxes of 5 or more cal/cm$^2$-sec. Further, owing to their low viscosity, the solutions are distributed more uniformly and finely over the target as a controlled fireball, thereby inflicting greater damage to combustible targets. However, such low viscosity PIB-TEA solutions are so reactive that they are pyrophoric even when exposed to the atmosphere in containers, spills, etc., and hence constitute a serious safety hazard in normal handling and shipping situations.

TEA is a pyrophoric liquid of high reactivity and energy content, which ignites on contact with air and reacts violently with water. Because of its reactivity, TEA presents problems in handling. Various methods are known for rendering TEA nonpyrophoric in bulk so that it no longer ignites spontaneously on contact with the atmosphere. One method is to thicken the TEA with PIB to a high viscosity level (about $1\times10^6$ cs) but such solutions are so thick that they do not flow readily and hence create a handling problem. Another method is to dilute the TEA with a hydrocarbon, such as hexane.

SUMMARY OF THE INVENTION

An object of the invention is to provide a pyrophoric composition possessing all of the advantages but none of the disadvantages of previous PIB-TEA pyrophoric compositions.

Another object is to provide low viscosity TEA-PIB compositions, which provide greater safety under normal handling conditions but when disseminated as fine particles into the atmosphere, are pyrophoric and provide a fireball, which is characterized by controlled ignition delay and rapid, essentially complete combustion and high energy output.

In accordance with the present invention, these and other objects are achieved by a novel, low-viscosity liquid composition consisting essentially of about from 50% to 85% by weight of a hemogeneous solution of polyisobutylene in triethylaluminum and about from 15% to 50% by weight of at least one saturated aliphatic hydrocarbon containing 5 to 12 carbon atoms, said composition having a viscosity ranging about from 30 centistokes to 150 centistokes at 40° C. When such a composition is explosively disseminated into the atmosphere, it exhibits a controlled ignition delay, which permits the hydrocarbon to be completely vaporized prior to spontaneous ignition of the TEA, thereby producing rapid pulses of intense thermal radiation possessing temperatures as high as 1200° C. (2192° F.) or higher and heat fluxes as high as 5 or more calories per cm$^2$-sec. and hence highly effective for defeating combustible targets.

DETAILED DESCRIPTION OF THE INVENTION

The low-viscosity pyrophoric compositions of the present invention can be obtained by mixing about from 50 to 85 parts, preferably about 70 parts, of a low viscosity PIB-TEA solution with about from 15 to 50 parts, especially about 30 parts, of the $C_5$–$C_{12}$ saturated aliphatic hydrocarbon such that the resulting composition possesses a viscosity of at least 30 cs at 40° C. but not exceeding 150 cs at 40° C., which corresponds closely to the viscosity of the PIB-TEA solution itself. Preferred compositions of this invention posses a viscosity ranging about from 50 cs at 40° C. to 100 cs at 40° C.

When the novel pyrophoric compositions are explosively disseminated on a target, as by a burster shell containing such a composition, the hydrocarbon will vaporize almost instantaneously into the atmosphere, rendering the TEA pyrophoric, which will then spontaneously burst into flame and produce the fireball. The novel compositions because of their viscosity produce a controlled fireball, which provides a sufficient time interval to permit essentially complete vaporization of the hydrocarbon in the cloud of dispersed particles prior to ignition of the TEA, thereby producing a very rapid pulse of thermal radiation which effectively defeats targets of interest. However, PIB-TEA-hydrocarbon compositions, which possess a viscosity substantially less than 30 cs at 40° C. cause such rapid reactions that the resulting fireball possesses insufficient dwell time to defeat combustible targets. On the other hand, PIB-TEA-hydrocarbon compositions having a viscosity substantially greater than about 150 cs at 40° C., when explosively disseminated in similar manner, produce clouds of relatively large particles with a resultant inferior target effect. Further, PIB-TEA-hydrocarbon compositions containing substantially more than 50% hydrocarbon will not be pyrophoric and produce flame (fireball) under dynamic conditions, i.e. when shot from a U.S. Army M74 Flame round, while compositions containing substantially less than 15% hydrocarbons are "too" pyrophoric in that ignition occurs before the dispersed composition is totally vaporized whereby a less intense pulse of thermal energy is generated.

We have found that by mixing limited proportions of the hydrocarbon with a low viscosity PIB-TEA solution in accordance with the present invention, it is possible to obtain a pyrophoric flame agent, which (a) is relatively nonpyrophoric when exposed to the atmosphere in bulk or spills and hence provides greater safety under normal handling conditions;

(b) is pyrophoric when dispersed into the atmosphere as a cloud of fine particles, which produces a controlled fireball, i.e., the ignition is delayed until the hydrocarbon is completely vaporized so that the composition is rapidly and completely burned to release its total thermal energy within a few seconds;

(c) produces an equal or greater incendiary effect than the aforesaid low viscosity PIB-TEA composition containing no added hydrocarbon, when the composition is explosively disseminated into the atmosphere.

A most important feature of the novel pyrophoric compositions is the fact that they provide a controlled fireball, which can release its total thermal radiation—and defeat a target—within a fraction of a second to one or only a very few seconds. More specifically, the novel compositions can produce a fireball, which processes a temperature exceeding 1200° C. and a heat flux of about five or more calories per centimeter squared/-second uniformly on targets, thereby inflicting significant damage to combustible targets. By contrast, conventional flame compositions and systems usually require tens of seconds to minutes to effect complete combustion thereof with consequent inferior ability to accomplish target defeat. The rapidity of target defeat with the controlled fireball obtained with the flame compositions of the present inventor minimizes any defensive actions which could be taken by defensive personnel such as fire-fighters.

The preferred hydrocarbons employed in the present compositions are n-hexane and cyclohexane. However, other saturated aliphatic hydrocarbons of 5 to 12 carbon atoms and mixtures thereof can be effectively employed according to the present invention, including n-pentane, n-heptane, n-octane, n-nonane, n-decane, n-undecane, n-dodecane, 2-ethylhexane, and methylcyclohexane.

Polyisobutylenes suitable for use as thickeners in the compositions of the present invention must possess a viscosity average molecular weight of between about 1,000,000 to 7,000,000, preferably between about 4,000,000 and 6,000,000. Suitable commercial polyisobutylene thickeners include Vistanex L-200, a polymerized isobutylene having a viscosity-average molecular weight of about 5,000,000, manufactured by Enjay Co., Inc., and Oppanol B-200.

The following examples provide further specific illustrations of the pyrophoric compositions of the present invention. The parts and percentages reported in the examples are by weight.

EXAMPLE 1

Test solutions were prepared by mixing n-hexane with PIB-TEA solutions (having a viscosity of 99 cs at 40° C. and obtained by dissolving approximately 1 part Vistanex L-200 in 100 parts TEA) in the ratios of 15/85, 30/70 and 50/50 parts of n-hexane/PIB-TEA solution. The resulting solutions ranged in viscosity from 68 to 90 cs at 40° C. 40 cc's of each test solution were placed in a sealed bottle. To test for pyrophoric activity, the covers were removed, and the solutions were exposed to air and observed for one minute. Only the 15/85 n-hexane/PIB-TEA solution smoked slightly, while the other solutions showed no smoke or reaction.

The solutions were then poured into shallow pans, during which a white smoke similar to the vapor emitted by dry ice in contact with water was observed emanating from each solution. Approximately 10 to 20 seconds later, the smoke thinned out and suddenly became a thick dense grayish-brown smoke which rapidly rose to fill the fume hood. Each solution smoked profusely for approximately 8 minutes. The pans were then shaken, which agitated each solution so that it ignited immediately into visible flames. During the smoking stage, a white crust (believed to be an aluminum oxide deposit) formed over the liquid; however, on agitation the crust broke and flames appeared. The solutions flamed between 5 to 10 seconds. Finally, a grayish-black residue or ash was left in the pans.

EXAMPLE 2

Comparative ignition tests were carried out with n-hexane/PIB-TEA solutions of the same formulations as those in Example 1 as well as with PIB-TEA solutions of various viscosities and neat TEA. The tests were performed in an apparatus, wherein a spring-loaded plunger breaks a cylindrical glass vial filled with approximately 4 ml of the test sample, thereby exposing the solution to a controlled atmosphere within the ignition chamber. All tests were performed at a chamber temperature of 25° C. Four samples of each solution were tested.

Table 1 sets forth the ignition-delay tests for the aforesaid solutions.

TABLE 1

Ignition-Delay Tests At 25° C.

| Flame Agent | Viscosity* cs | Ignition Delay msec | Burn Time sec |
|---|---|---|---|
| Neat TEA | 2.4 | 20.4 ± 2.5 | 1.0 |
| PIB-TEA | 10.0 | 54.8 ± 41.5 | 2.0 |
| PIB-TEA | 50.0 | 57.3 ± 16.2 | 2.4 |
| PIB-TEA | 99.0 | 57.9 ± 20.6 | 2.7 |
| PIB-TEA | 1600.0 | 85.5 ± 67.8 | 3.6 |
| PIB-TEA | $1.0 \times 10^4$ | 223.8 ± 144.2 | 7.4 |
| PIB-TEA | $1.0 \times 10^5$ | Erratic ignition | — |
| PIB-TEA | $1.0 \times 10^6$ | No ignition | — |
| 15/85 n-Hexane/PIB-TEA | 96.0 | No ignition | — |
| 30/70 n-Hexane/PIB-TEA | 75.0 | No ignition | — |
| 50/50 n-Hexane/PIB-TEA | 96.0 | No ignition | — |
| 30/70 n-Hexane/PIB-TEA | 36.0 | No ignition | — |

*Viscosity was measured at 40° C.

EXAMPLE 3

30/70 n-Hexane/PIB-TEA solutions, 30/70 cyclohexane/PIB-TEA solutions and PIB-TEA solutions were prepared as described above. 30 milliliters of each solution were poured into shallow aluminum pans 4 inches square and 1 inch deep open to the air.

The experimental results set forth in Table 2 show that the PIB-TEA solutions containing n-hexane or cyclohexane are much less reactive than PIB-TEA solutions of similar viscosity containing no hexane or cyclohexane. The reactivities of the cyclohexane/PIB-TEA and n-hexane/PIB-TEA compositions are not significantly different.

TABLE 2

Spill Tests In Shallow Pans

| Flame Agent | Viscosity* cs | Duration of pour sec | Duration of light smoke sec | Duration of heavy smoke sec | Total reaction time sec |
|---|---|---|---|---|---|
| 30/70 n-Hexane/PIB-TEA | 31.7 | 5 | 400 | 145 | 545 |
| 30/70 n-Hexane/PIB-TEA | 42.1 | 5 | 400 | 148 | 548 |
| 30/70 n-Hexane/PIB-TEA | 52.2 | 7 | 527 | 172 | 699 |
| 30/70 n-Hexane/PIB-TEA | 59.5 | 345 | 208 | 553 | |

TABLE 2-continued

| Flame Agent | Viscosity* cs | Duration of pour sec | Duration of light smoke sec | Duration of heavy smoke sec | Total reaction time sec |
|---|---|---|---|---|---|
| | Spill Tests In Shallow Pans | | | | |
| 30/70 n-Hexane/PIB-TEA | 71.8 | 6 | 323 | 211 | 544 |
| 30/70 Cyclohexane/PIB-TEA | 56.5 | 7 | 312 | 207 | 519 |
| 30/70 Cyclohexane/PIB-TEA | 86.9 | 4 | 433 | 177 | 610 |
| PIB-TEA | 99.4 | 10 | 164 | 178 | |

*Viscosity was measured at 40° C.

EXAMPLE 4

Dynamic flame weapon system tests were carried out by firing a flame rocket from a rocket launcher into a concrete bunker 6.5 ft high, 5 ft wide and 7.5 ft deep, inside dimensions. The flame rounds were standard U.S. Army M74 flame rounds, which consisted of a rocket motor containing propellant grains, and an aluminum warhead containing approximately 725 ml of the flame composition, a burster charge for disseminating the flame composition and a fuze for initiating the burster charge. The rounds were functional as airbursts 2 to 3 feet inside the bunker by firing them through a ½ inch mesh hardware cloth, which was mounted in the embrasure of the bunker and was strong enough to function the fuze. When the burster charge was initiated, a force of approximately 1100 ft. lb. was applied to the flame agent composition. The bunker was monitored for temperature, heat flux and overpressure, using thermocouples, calorimeters and pressure transducers, respectively.

Table 3 sets forthe the flame compositions tested as well as the monitored data for the test firings. The PIB-TEA solutions, which were used as such or mixed with n-hexane or cyclohexane, were obtained as described in Example 1. The results show that (a) The low viscosity PIB-TEA compositions generate a significant increase in temperature, heat flux and overpressure over the high viscosity PIB-TEA compositions. Further, there is a significant increase in the target area coverage due to the more uniform distribution of the low viscosity PIB-TEA compositions' total radiant energy. This is shown by the greater mean temperature values produced by the low viscosity PIB-TEA composition in all of the tests; and (b) the n-hexane (cyclohexane)/PIB-TEA compositions of the present invention produce equivalent or even greater heat effects on target than the low viscosity PIB-TEA compositions, but as shown above, provide greater safety under normal handling conditions and hence are much more desirable for practical use.

TABLE 3

| Flame Agent | Viscosty[a] CS | Maximum Temperature °C. | Maximum Temperature °F. | Mean Temperature °C. | Mean Temperature °F. | Mean[b] Temperature-time °C.-sec | Mean[b] Temperature-time °F.-sec | Max[C] Heat Flux | Mean[c] Heat Flux | Mean[b] Flux-Time cal/cm² | Over-Pressure psig |
|---|---|---|---|---|---|---|---|---|---|---|---|
| PIB-TEA[d] | 175,000 | 1151 | 2104 | 451 | 844 | 2377 | 4502 | 2.88 | 1.81 | 5.66 | 0.49 |
| PIB-TEA[e] | 50 | 1051 | 1923 | 497 | 927 | 1918 | 3577 | 5.52 | 4.02 | 7.14 | 4.67 |
| PIB-TEA[d] | 25 | 1280 | 2336 | 875 | 1607 | 2558 | 4828 | 6.85 | 5.73 | 5.88 | 7.31 |
| 30/70 n-Hexane/PIB-TEA[e] | 32 | 1236 | 2257 | 829 | 1525 | 2820 | 5300 | 5.60 | 4.92 | 7.77 | 2.60 |
| 30/70 n-Hexane/PIB-TEA[e] | 42 | 1224 | 2235 | 873 | 1603 | 2602 | 4907 | 5.55 | 3.42 | 8.11 | 4.52 |
| 30/70 n-Hexane/PIB-TEA[e] | 46 | 1231 | 2248 | 827 | 1521 | 2758 | 5188 | 5.77 | 4.71 | 8.63 | 4.11 |
| 30/70 n-Hexane/PIB-TEA[e] | 52 | 1198 | 2189 | 709 | 1308 | 2488 | 4510 | 6.30 | 5.02 | 9.10 | 1.10 |
| 30/70 n-Hexane/PIB-TEA[e] | 60 | 1101 | 2013 | 877 | 1611 | 3157 | 5906 | 4.76 | 4.46 | 7.27 | 2.82 |
| 30/70 n-Hexane/PIB-TEA[e] | 72 | 1178 | 2153 | 849 | 1561 | 2642 | 4979 | 5.35 | 4.80 | 5.91 | 3.13 |
| 30/70 n-Hexane/PIB-TEA[e] | 110 | 1217 | 2223 | 800 | 1472 | 2517 | 4755 | 5.19 | 4.76 | 7.27 | 3.32 |
| 30/70 n-Cyclohexane/PIB-TEA[e] | 57 | 1141 | 2085 | 780 | 1436 | 2443 | 4622 | 5.93 | 4.84 | 8.13 | 3.45 |
| 30/70 Cyclohexane/PIB-TEA[e] | 87 | 1132 | 2069 | 812 | 1494 | 3160 | 5720 | 5.35 | 4.82 | 9.18 | 2.66 |

[a]At 40° C.
[b]At the end of 7 seconds.
[c]Calories/cm²-sec.
[d]Average of three tests.
[e]Average of two tests.

What is claimed is:

1. A low-viscosity liquid pyrophoric composition, which provides increased safety under normal handling conditions but when disseminated into the atmosphere produces a fireball of controlled ignition delay and rapid, essentially total combustion and evolution of the thermal energy thereof, consisting essentially of about from 50% to 85% by weight of a homogeneous solution of polyisobutylene in triethylaluminum and about from 15% to 50% by weight of at least one saturated aliphatic hydrocarbon containing 5 to 12 carbon atoms, said composition having a viscosity ranging about from 30 to 150 centistokes at 40° C.

2. A composition according to claim 1, consisting essentially of about 70% by weight of a solution of polyisobutylene in triethylaluminum and about 30% by weight of at least one saturated aliphatic hydrocarbon containing 5 to 12 carbon atoms.

3. A composition according to claim 1, wherein the hydrocarbon is n-hexane.

4. A composition according to claim 1, wherein the hydrocarbon is cyclohexane.

5. A composition according to claim 1, wherein the viscosity ranges about from 50 to 100 centistokes at 40° C.

6. A composition according to claim 1, wherein the solution of polyisobutylene in TEA consists essentially of about 1 part of polyisobutylene having a viscosity-average molecular weight of about 5,000,000 per 100 parts of triethylaluminum.

* * * * *